United States Patent [19]

Fitzgerald-Smith

[11] Patent Number: 4,561,376

[45] Date of Patent: Dec. 31, 1985

[54] TRANSPORTABLE PONTOON

[75] Inventor: James P. Fitzgerald-Smith, Ossemsley, England

[73] Assignee: The Secretary of State for Defence in Her Britannic Majesty's Government of the United Kingdom of Great Britain and Northern Ireland, London, England

[21] Appl. No.: 604,656

[22] PCT Filed: Aug. 4, 1983

[86] PCT No.: PCT/GB83/00193

§ 371 Date: Apr. 18, 1984

§ 102(e) Date: Apr. 18, 1984

[87] PCT Pub. No.: WO84/00731

PCT Pub. Date: Mar. 1, 1984

[51] Int. Cl.[4] ..... B63B 35/36

[52] U.S. Cl. ..... 114/267; 14/26; 14/27; 114/353; 114/354

[58] Field of Search ..... 114/353, 354, 270, 267, 114/258, 263, 266; 14/2.4, 2.6, 27, 28, 29, 30

[56] References Cited

U.S. PATENT DOCUMENTS

| | | | |
|---|---|---|---|
| 1,750,224 | 3/1930 | King | 114/258 |
| 2,480,144 | 8/1949 | Laycock | 14/27 |
| 2,562,431 | 7/1951 | Maile | 114/270 |
| 2,977,606 | 4/1961 | Straussler | 114/353 |
| 4,386,441 | 6/1983 | Lundholm | 14/27 |

FOREIGN PATENT DOCUMENTS

| | | |
|---|---|---|
| 1926438 | 12/1970 | Fed. Rep. of Germany . |
| 2489389 | 3/1982 | France . |
| 936438 | 9/1963 | United Kingdom . |

*Primary Examiner*—Trygve M. Blix
*Assistant Examiner*—Thomas J. Brahan
*Attorney, Agent, or Firm*—Cushman, Darby & Cushman

[57] ABSTRACT

A foldable, multi-hull pontoon suitable for use in bridging or as a ferry, has a sequence of trapezoidal hull plates (1) successively hinged to one another at their parallel edges so as to fold in concertina fashion, alternate pairs of the plates being mutually and transversely webbed at each end with collapsible triangular bulkheads (7) which define with the hull plates a series of triangular section hulls (13). Gunwale spacing beams (40) are provided to stabilise the opened pontoon and to provide trackways.

9 Claims, 4 Drawing Figures

TRANSPORTABLE PONTOON

TECHNICAL FIELD

This invention relates to a pontoon which can be folded for transportation upon a road vehicle. The pontoon is particularly, but not exclusively, applicable for use in bridging or as a ferry.

BACKGROUND ART

The majority of known transportable pontoons have the disadvantage of being bulky and are disproportionately expensive to transport, a very large part of the transported volume being air. Attempts have been made to improve this situation by designing nestable pontoons, but even with these, a considerable amount of air space still requires transporting. Furthermore, most existing pontoons must be launched and assembled individually and their deployment can be a time-consuming task in any bridging or ferrying operation.

The present invention seeks to provide a foldable pontoon suitable for rapid deployment and having minimal enclosed air space in the transport mode.

DISCLOSURE OF INVENTION

According to the present invention a transportable pontoon includes: a multiplicity of substantially planar hull members each having a keel edge and a parallel gunwale edge, which members are successively hinged in sealed relationship at alternately conjoined keel edges and gunwale edges so as to fold respectively inwardly and outwardly in concertina fashion; and a collapsible bulkhead member extending in sealed relationship between each inwardly folding pair of hull members adjacent each end thereof, which bulkhead members define with the hull members a sequence of parallel hulls when the pontoon is extended.

The bulkhead members may each conveniently comprise a flexible membrane which will fold between the hull members when they are closed towards one another. Alternatively each bulkhead member may comprise a centrally articulated pair of plates, hinged at their outer edges to the associated hull members so as to fold inwards when the pontoon is folded.

Sealed hinged inter-connection of the hull and bulkhead members may be conveniently achieved by the use of flexible joints sealed between the respective members. Alternatively, where a more robust construction is required, the hinges are preferably of conventional, non-sealing pin type in combination with a supplementary sealing means, for example, a flexible membrane sealed to the conjoined members in parallel with the pin hinge so as to bridge the gap between the members.

The hull members are preferably of a buoyant material and weighted at the keel edges so as to have position meta-centers to ensure that the pontoon will float upright when folded. This permits the pontoon to be speedily launched whilst still folded and easily unfolded whilst water-borne thus avoiding the necessity of employing cranes.

The pontoon preferably further includes at least one gunwale spacing beam for use when the pontoon is opened, which beam is provided with spaced engagement means successively co-operative with each conjoined pair of gunwale edges so as to locate them. The beam also provides transverse stiffening to the hulls.

The spacing beam may also be used to connect together two similar pontoons by co-engaging the outermost gunwales of both, thereby to extend the sequence of parallel hulls. These spacing beams may additionally be arranged to serve as trackways or to support subsidiary trackways.

BRIEF DESCRIPTION OF DRAWINGS

An embodiment of the invention will now be described by way of example only with reference to the accompanying drawings of which

BEST MODE FOR CARRYING OUT THE INVENTION

Figure 1:
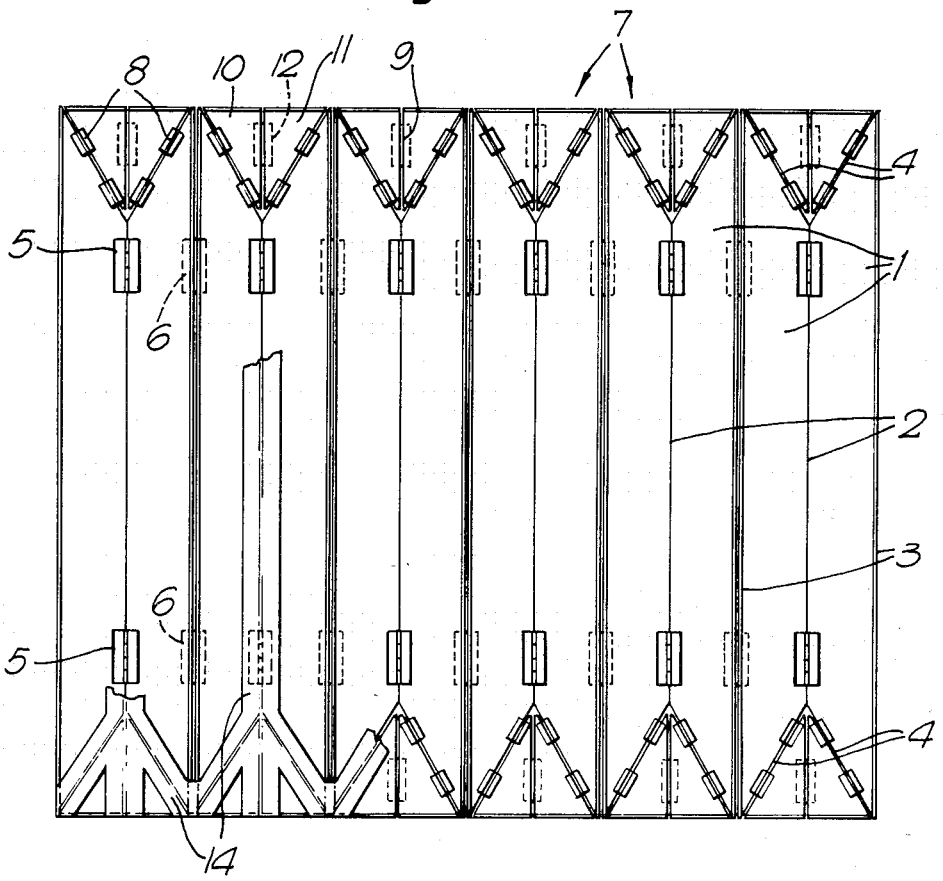
FIGS. 1 and 2 are a plan view and an end elevation view respectively of an unfolded, 6-hull pontoon.
Figure 2:
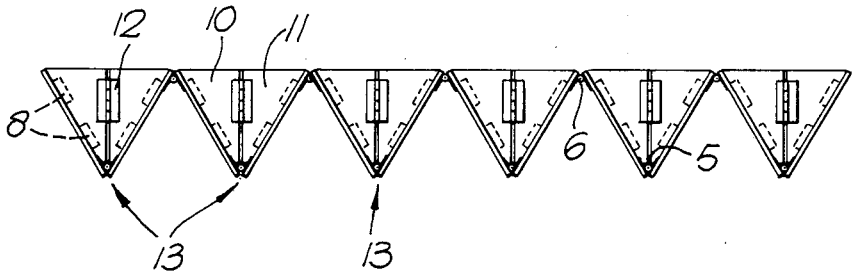

The six-hull pontoon illustrated in FIGS. 1 and 2 comprises twelve identical trapezoidal hull plates 1 of a bouyant composite material such as a resin honeycomb within an alloy skin, each plate having a keel edge 2, a gunwale edge 3 and two bulkhead edges 4. The plates 1 are successively interconnected by inner hinges 5 at the keel edges 3, and outer hinges 6 at the gunwale edges 4 so as to fold alternately inwardly and outwardly.

A folding bulkhead plate 7 of equilateral triangular form is connected transversely between the bulkhead edges 4 at each end of each inwardly folding pair of hull plates 1 by inner hinges 8, the bulkhead plate 7 being divided at its centre line 9 into two symmetrical triangular portions 10 and 11 interconnected by outer hinges 12 so that the portions 10 and 11 will fold inwardly to lie between the hull plates 1 when the pontoon is folded.

The relative sizes and the material densities of the hinges 5, 6, 8 and 12 are selected to provide that the assembled plates are preferentially weighted at the keel edges 2 so that the hull plates will float upright in the folded condition.

When the pontoon is open, the hull plates 1 and the bulkhead plates 7 conjointly define six parallel hulls 13, all the interconnections of which are internally sealed against ingress of water by a flexible membrane strip 14 adhesively applied to the conjoined members so as to bridge the gap between them.

Figure 3:
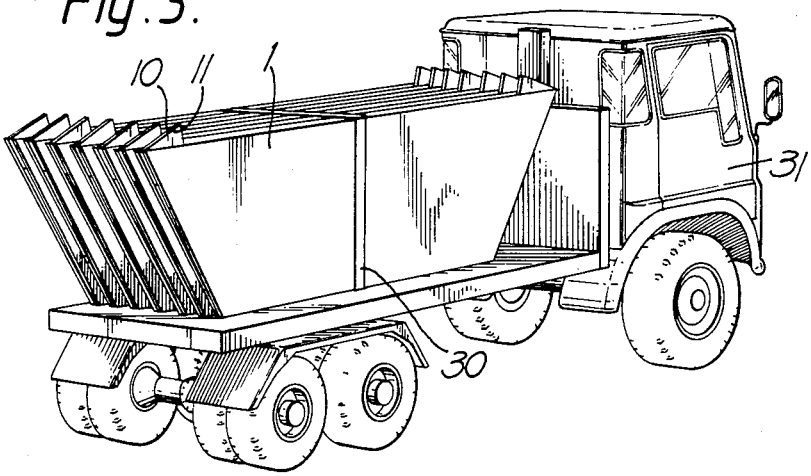
FIG. 3 is a view of the same pontoon folded for transportation.

The pontoon is bound in folded condition with a securing strap 30 (see FIG. 3) and may be conveniently launched into a river from a conventional tilt truck 31.

Figure 4:
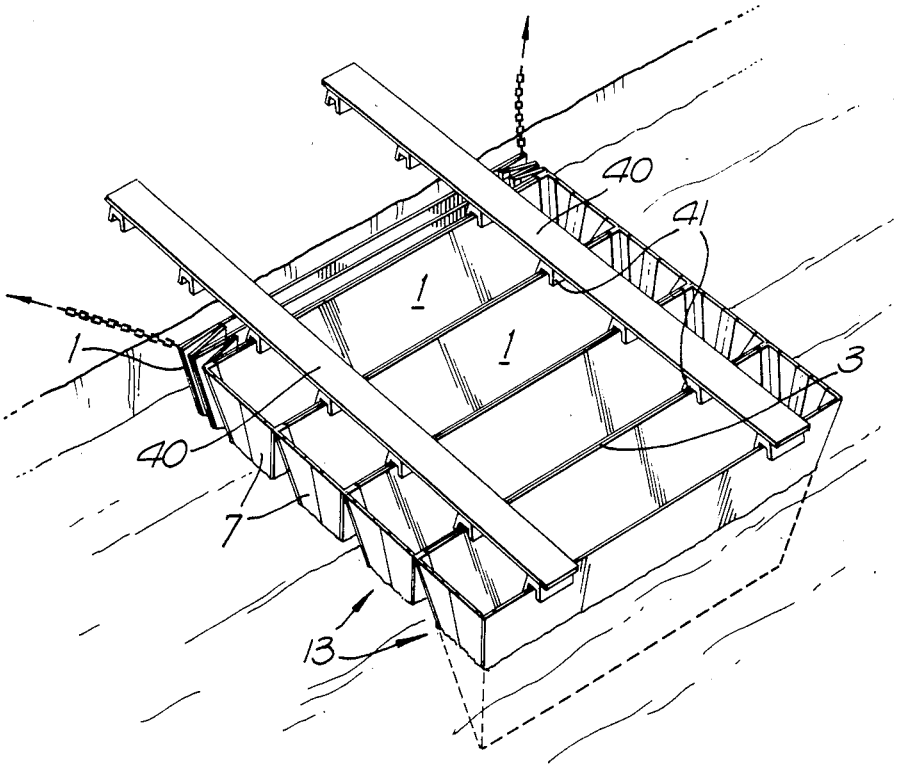
FIG. 4 is a representation of the same pontoon during launch.

Subsequent unfolding of the launched pontoon is illustrated in FIG. 4. The folded hulls 13 are first brought into alignment with the bank and the nearest hull plate 1 is tethered to the bank. Two gunwale spacing beams 40, each having seven spaced gunwale engagement sockets 41, are then first engaged with the gunwale edge 3 of the outermost hull 13 and pushed outwardly from the bank so as to open the pontoon and permit the sockets 41 to engage successively with the gunwale edges 3 of each of the hulls 13.

A greater pontoon length may be provided by co-engaging the final socket 41 with the outermost gunwale of a second folded pontoon inserted between the already unfolded one and the bank, which second pontoon is then similarly unfolded with further spacing beams 40. It will be apparent that this process can be continued with successive pontoons and spacing beams to provide a ribbon bridge of desired length.

The spacing beams also serve as trackways across the pontoons or may be provided with support means (not shown) for subsidiary trackways.

A typical pontoon having 22 hulls comprised by 44 hull plates each measuring 9 m (at the gunwale edge)×2 m can be compacted for transportation into a block which is no more than 2.4 m thick, and unfolded into a raft measuring 9 m×40 m having a depth of 1.8 m in a few minutes without the use of cranes. The unladen pontoon, which has a free-board of 0.8 m, will survive a 9 knot current in the direction of the keels and can be crossed in currents of up to 6 knots by normal bridge loads typically reducing the free-board to 0.5 m.

When the pontoon is intended for use as a ferry, i.e. to be driven in the direction of the keels, an apron (not shown) is preferably fitted over the bow and stern bulkheads so as to shed water from a central ridge to the outer-most gunwale to prevent swamping.

A particular advantage of the triangular multi-hull configuration of this embodiment of the invention over conventional flat-bottomed pontoons is the increased resistance offered by the folded plate structure to vertical crushing loads such as can be applied to a pontoon when it is in a grounded state.

A further advantage offered by the inherent stability of the folded pontoon is the capability of deployment by dropping from a transport aircraft.

It will be seen that the equilateral triangular hull sections of the particular embodiment described provide a pontoon which floats with approximately one half of its depth submerged when not loaded. Other embodiments of the present invention having less draught can be provided by including pairs of hull plates of shorter gunwale height in the sequence. For example, a pair of short gunwale-height plates so as to provide consecutive pairs of hulls with intersecting V-sections, i.e. pairs mutually having an open W-section. In such an arrangement the conjoining bulkhead members would be extended to full gunwale height and the gunwale spacing bars would engage with the full-height gunwales only. Obviously the number of pairs of short plates intermediate each pair of full plates can be increased to reduce draught still further, but resistance of the structure to crushing loads will of course decrease proportionally.

INDUSTRIAL APPLICABILITY

The invention may be used to provide self-contained bridge supporting pontoons or ferrying pontoons as already described. Structures in accordance with the invention may also be attached as folding side panels to an amphibious vehicle so as to be extendable when the vehicle is afloat, thereby to increase the vehicle's beam and buoyancy, and hence increase its stability and load bearing capacity.

I claim:

1. A transportable pontoon comprising:

a plurality of substantially planar hull members each having a (1) keel edge, (2) a gunwale edge, substantially parallel to said keel edge, and (3) at least two bulkhead edges;

hinging means for hinging said members in sealed relationship at alternately conjoined keel edges and gunwale edges so as to fold in concertina fashion, thus allowing said pontoon to be substantially uniplanar when folded; and bulkhead member means extending in sealed relationship between each inwardly folding pair of hull members, for defining with said hull members a sequence of open top, hollow parallel hulls each having a triangular cross-section when said pontoon is extended.

2. A pontoon as claimed in claim 1 characterised in that said each hull member is of a buoyant material and weighted at said keel edge so as to float substantially vertically when said pontoon is folded.

3. A pontoon as claimed in claim 2 further including at least one gunwale spacing beam having spaced engagement means for engaging with said gunwale edges and holding said gunwale edges in spaced relation to one another.

4. A pontoon as in claim 1 wherein said hinging means comprises:

hinge means for folding said hull members in concertina fashion when said pontoon is extended; and sealing means, covering said hinge means, for ensuring that said hinging means forms a watertight seal between said hull members.

5. A pontoon as in claim 4 wherein the relative sizes and weights of said hinge means are selected so as to weight said keel edge so that said pontoon will float upright in the folded position.

6. A pontoon as in claim 4 wherein said sealing means is a flexible membrane strip.

7. A method of launching a transportable pontoon having a plurality of planar hull members, hinge means for folding said hull members in a concertina fashion, and bulkhead members extending between inwardly folding hull members to form a series of parallel hulls with triangular cross-sections, comprising the steps of:

a. dropping the folded pontoon into a water gap, b. tethering the near-end hull member of said folded pontoon to the bank of said water gap, c. engaging the far-end gunwale edge with a far-end engagement means of a gunwale spacing beam, and d. thrusting said far-end gunwale edge away from said bank with said gunwale spacing beam, whilst successively co-engaging each of said engagement means and gunwale edges in inwardly directed sequence as said pontoon extends.

8. A transportable pontoon assembly, said pontoon being substantially flat when folded and being hollow, and open topped, and having a triangular cross-section when extended, comprising:

a plurality of planar hull member means for forming a uniplanar structure when folded, and forming a generally triangular cross-section structure when extended, each said hull member having (1) a keel edge, adapted to be pointed downward when said pontoon is extended, (2) a gunwale edge, substantially parallel to said keel edge, and (3) at least two bulkhead edges;

hinge means for pivotally attaching said hull members to one another so that said assembly can be folded: (1) to a substantially uniplanar structure and (2) in concertina fashion to a structure with a substantially triangular cross-section;

sealing means, covering said hinge means, for ensuring a watertight seal between said hull member means;

a plurality of bulkhead member means joined to said hull members along said bulkhead edges, for forming a uniplanar structure along with said hull member means when folded, and for extending in a generally perpendicular relation to said hull member means when said assembly is extended, and closing the ends of said triangular cross-section structure;

bulkhead hinge means for pivotally attaching each of said bulkhead member means to a planar hull member along said bulkhead edge, so that said assembly can be folded: (1) to a uniplanar structure and (2) so that said bulkhead member means extend generally perpendicular to said hull member means;

bulkhead sealing means, covering said bulkhead hinge means, for ensuring a watertight seal between said hull member means and said bulkhead member means along said bulkhead edge; and gunwale spacing beam means for holding said gunwale edges in spaced parallel relation when said assembly is extended.

9. An assembly as in claim 8 wherein said gunwale spacing beam means includes means for consecutively engaging said gunwale spacing beam means with each said gunwale edge and thus extending said assembly.

* * * * *